US008870055B2

(12) United States Patent
Backman

(10) Patent No.: US 8,870,055 B2
(45) Date of Patent: Oct. 28, 2014

(54) PACKAGE, SHEET FOR A PACKAGE AND A METHOD FOR THE MANUFACTURING THEREOF

(76) Inventor: Gunnar Backman, Örsundsbro (SE)

( * ) Notice: Subject to any disclaimer, the term of this patent is extended or adjusted under 35 U.S.C. 154(b) by 2 days.

(21) Appl. No.: 13/877,477

(22) PCT Filed: Oct. 4, 2011

(86) PCT No.: PCT/SE2011/051181

§ 371 (c)(1),
(2), (4) Date: Apr. 3, 2013

(87) PCT Pub. No.: WO2012/047161

PCT Pub. Date: Apr. 12, 2012

(65) Prior Publication Data

US 2013/0240613 A1 Sep. 19, 2013

(30) Foreign Application Priority Data

Oct. 5, 2010 (SE) ..... 1000981

(51) Int. Cl.

| | |
|---|---|
| ***B65D 5/355*** | (2006.01) |
| ***B65D 37/00*** | (2006.01) |
| ***B65D 75/58*** | (2006.01) |
| ***B31B 1/00*** | (2006.01) |
| *B65D 85/74* | (2006.01) |

(52) U.S. Cl.

CPC ..... *B65D 37/00* (2013.01); *B65D 75/58* (2013.01); *B65D 75/5888* (2013.01); *B31B 1/00* (2013.01); *B65D 2575/586* (2013.01); *B65D 85/74* (2013.01)

USPC ..... 229/101.1; 229/101.2; 229/125.19

(58) Field of Classification Search

USPC ..... 229/101.1, 101.2, 125.19, 235

See application file for complete search history.

(56) References Cited

U.S. PATENT DOCUMENTS

| | | | | |
|---|---|---|---|---|
| 2,251,283 | A * | 8/1941 | Johnson | 229/101.2 |
| 2,474,523 | A | 6/1949 | Guyer | |
| 3,235,166 | A * | 2/1966 | Guyer | 229/125.19 |

(Continued)

FOREIGN PATENT DOCUMENTS

| | | |
|---|---|---|
| DE | 2133758 | 1/1973 |
| DE | 202005006978 | 9/2006 |
| GB | 2352439 A | 1/2001 |

*Primary Examiner* — Gary Elkins

(74) *Attorney, Agent, or Firm* — Capitol City TechLaw

(57) ABSTRACT

A package (1) manufactured in a single piece of a flexible sheet (2). The package (1) comprises a lid (3) that can be opened and re-closed. The lid (3) is integrated with the package (1). The lid (3) is joined to the package 81) along a perforation line (5). The lid (3) has side walls (7*a-d*) of double-folded sheet material folded downwards along the perforation line (5) and then folded back upwards. There are cuts (8*a, b*) in the perforation line (5) in distal opposite ends thereof such that loose lid flaps (11 *a, b*) are provided on each side of the sheet (2) when the package (1) is folded along a longitudinal side, wherein a loose corner (12) is provided in the lid (3). The package (1) comprises a lid (3) that can be opened by a user a first time tearing off the lid (3) from the package (1). The package is provided with transverse tear-off strips (13) arranged around the package (1). The lid can be put back to reclose the package (1), also after partial drawing of the product. A sheet for manufacturing the package and a method for manufacturing said sheet are also disclosed.

8 Claims, 2 Drawing Sheets

(56) References Cited

U.S. PATENT DOCUMENTS

| | | | | | |
|---|---|---|---|---|---|
| 3,539,093 | A | | 11/1970 | Massengill | |
| 3,955,747 | A | * | 5/1976 | Bell | 229/117.12 |
| 3,967,773 | A | * | 7/1976 | Kaufmann | 229/101.1 |
| 4,310,093 | A | | 1/1982 | Manser | |
| 4,349,110 | A | * | 9/1982 | Hayashi | 229/101.1 |
| 4,421,236 | A | | 12/1983 | Lowe | |
| 4,804,138 | A | * | 2/1989 | McFarland | 229/117.12 |
| 5,470,016 | A | * | 11/1995 | Ljungstrom et al. | 229/101.1 |

* cited by examiner

PACKAGE, SHEET FOR A PACKAGE AND A METHOD FOR THE MANUFACTURING THEREOF

TECHNICAL FIELD

The present invention relates to a package for various products, in particular a food product inside a package of flexible material, which package can be opened and reclosed after each partial drawing of the product.

The present invention is also related to a sheet for such a package and a method for manufacturing the same.

BACKGROUND

Various types of flexible packages, in particular for easily perishable food products such as butter and margarine, consisting of envelopes of flexible material able to exclude the exposure of the product to the surroundings and at the same time allow the product to be recognized through inscriptions and designs on the envelope are well known.

A drawback with present flexible packages of envelope type is that they cannot be reclosed easily once they are opened to allow partial drawing of the product, in particular not multiple times. In the practice, this forces a user to seek expedients to try to close the product as good as possible after each drawing, for example folding an open side of the package over itself, or wrapping the package inside plastics films or other sorts of external envelopes. All of these measures are cumbersome.

Another drawback with present packages of envelope type is that the package tends to be greasy on an outside after partial drawing of the product. Often, the package also looses its shape after a number of partial drawings of product.

Yet another drawback is that partial drawing of the product according to a particular volume or weight is not very easy for a user to accomplish since a weight scale is typically only present on a single side of the package. For instance, a package of butter of envelope type requires that the user cuts very straight according to the single side scale, which is normally difficult.

Thus, there exist a number of disadvantages with known flexible packages.

Also other packages than of envelope type are known. For example, U.S. Pat. No. 4,310,093 describes a folding box and blank for fabricating the same. The blank is formed of foldable material such as paperboard. A tuckable or insertable cover is provided, which is folded out of the blank for the folding box.

SUMMARY OF THE INVENTION

According to an aspect, the present invention provides a package manufactured in a single piece of a flexible sheet of package material. The package comprises a lid that can be opened and reclosed and is integrated with the package. The lid is joined to the package along a perforation line. The lid has side walls of double-folded sheet material folded downwards to the perforation line and back upwards. There are cuts in the perforation line in distal opposite ends thereof such that loose lid flaps are provided on each side of the sheet when the package is folded along a longitudinal side, wherein a loose corner is provided in the lid.

The inventive package provides a lid that can be opened by a user a first time by lifting the loose corner and tearing off the lid from the package whereby the perforation breaks along the perforation line. The lid that can be referred to as a "tear open lid", can be put back to reclose and reseal the package, also after partial drawing of the product.

In this way, the inventive package will not be greasy after partial drawing of the product, even not after a plurality of partial drawings of the product. Provided the flexible sheet has a suitable stiffness, the package will retain its shape even after multiple partial drawings of the product followed by re-closing the package.

According to our best knowledge, this is not disclosed in any prior art document, or known in any other way until now.

According to an embodiment of the present invention, the inventive package further has transverse tear-off strips arranged around the package.

In this way, a user can tear-off one or more tear-off strips such that a part of the product content is exposed freely. The product can be covered by the lid when put back to re-close the package.

Typically, each tear-off strip is provided with a weight or volume indication, such as a weight scale, of product content in the package for a particular weight or volume based partial drawing of the product. Since the scale is provided around the entire package it is easy for a user to measure a proper amount of product.

By means of the tear-off strips being teared-off, the package will not be greasy even after partial drawing of the product content.

According to an embodiment of the present invention, there is provided a sheet for manufacturing a package comprising a lid that can be opened and re-closed, which is integrated with the package, the latter manufactured in a single piece of a flexible sheet material. The sheet is typically essentially rectangular and divided into a set of transverse fields divided by means of perforations and/or punched lines.

According to another aspect of the present invention, there is also provided a method for manufacturing a sheet for manufacturing a package by means of folding. The method comprises:

providing a sheet for manufacturing a package; wherein the sheet is punched and perforated to form folding and tearing lines to provide:

a first field for forming a top surface of the lid, a second field located adjacent and in parallel to the first field, arranged to form the side walls of the lid, a third field located adjacent and in parallel to the second field and arranged to form the side walls of the package, and a fourth field located adjacent and in parallel to the third field and arranged to form a bottom surface of the package. The second and the third fields are divided by a perforation line and cuts are provided in distal ends, or end regions of the perforation line.

BRIEF DESCRIPTION OF THE DRAWINGS

The features and advantages of the present invention as described and additional ones will become further apparent from the following detailed description and the accompanying drawings, of which.

DETAILED DESCRIPTION OF THE INVENTION

Figure 1:
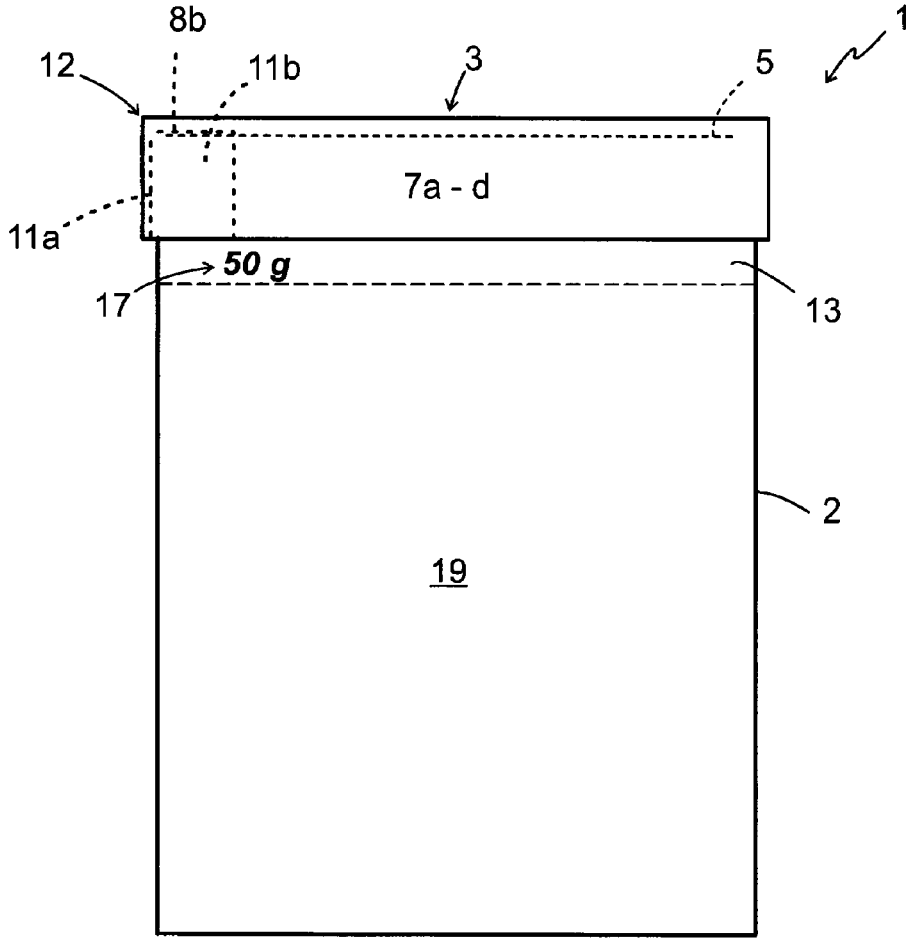
FIG. 1 is a side-view of a package manufactured in a single piece of flexible sheet according to an embodiment of the present invention.

Now is referred to FIG. 1 illustrating a package 1 manufactured in a single piece of flexible sheet 2 according to an embodiment of the present invention.

The package 1 comprises a lid 3 that can be opened and reclosed and that is integrated with the package 1. The lid 3 is joined to the package 1 along a perforation line 5 shown by a dashed line because it is hidden under the lid 3 in FIG. 1, such that the lid 3 is integrated with the package 1. The perforation line 5 is also somewhat lower shown for simplicity. The lid 3 has side walls 7*a-d* (of which only one wall 7*a* is shown in this view) of double-folded sheet material folded downwards to the perforation line 5 and back upwards. There are cuts 8*a, b* in the perforation line 5 in distal opposite ends, or end regions, thereof such that loose lid flaps 11*a, b* are provided on each side of the sheet 2 when the package 1 is folded along the longitudinal side 7*a*, wherein a loose corner 12 is provided in the lid 3. The length of the lid flaps 11 *a, b* correspond to the length of the cuts 8*a, b*. It is the two outer lid flaps of the sheet 2 that provide the loose lid flaps 11*a, b* (See FIG. 2). The lid 3 is loose in relation to the side walls 19 of the package 1. The package 1 is manufactured in a single piece of a flexible sheet. The package 1 has transverse tear-off strips 13 arranged around the package 1. Since the tear-off strips 13 are teared-off and removed following partial withdrawal of the product content, the package will stay clean and non-greasy.

Since the package and lid is made in one piece, the package is simple and non-expensive to produce.

Figure 2:
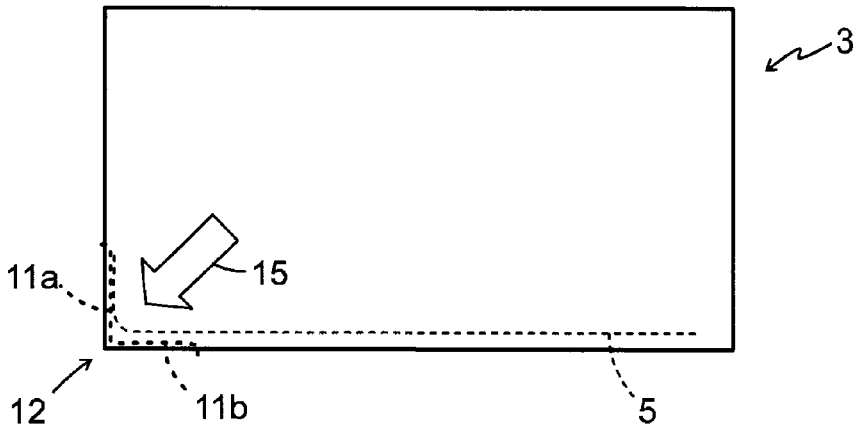
FIG. 2 is a top view of the package in FIG. 1 having a lid in a first unbroken or re-closed position.

Now is referred to FIG. 2, which is a top view of the package 1 in FIG. 1 illustrating the lid 3 in a non-opened first position before use. The lid 3 can be opened by a user a first time by lifting the loose corner 12 and tearing off the lid 3 from the package 1. This will be further disclosed below.

The package 1 can be provided with a weight or volume indication 17 such as "50 g" for a particular weight or volume based partial drawing of the product, herein "50 g" stands for 50 grams of product. The package 1 will be shorter and shorter after each partial drawing of the product. In FIG. 1 the package 1 is shown with no tear-off strip 13 having been teared off.

Provided the flexible sheet 2 has a suitable stiffness, the package 1 will retain its shape even after multiple partial drawings of the product followed by re-closing the package 1. In this way, the inventive package 1 will not be greasy after partial drawing of the product, not even after a plurality of partial drawings of the product. The lid 3 will not loose its shape compared to conventional packages. The package is also hygienic and rigid.

The package illustrated in FIGS. 1 and 2 has rectangular shape. However, the shape can be square or even circular. The lid 3 is made of double-folded sheet material in the same way also in these alternative embodiments of the invention. These particular embodiments of the present invention will not be further disclosed herein since they are similar to the embodiment described in FIG. 1 and therefore obvious for a skilled person.

Figure 3:
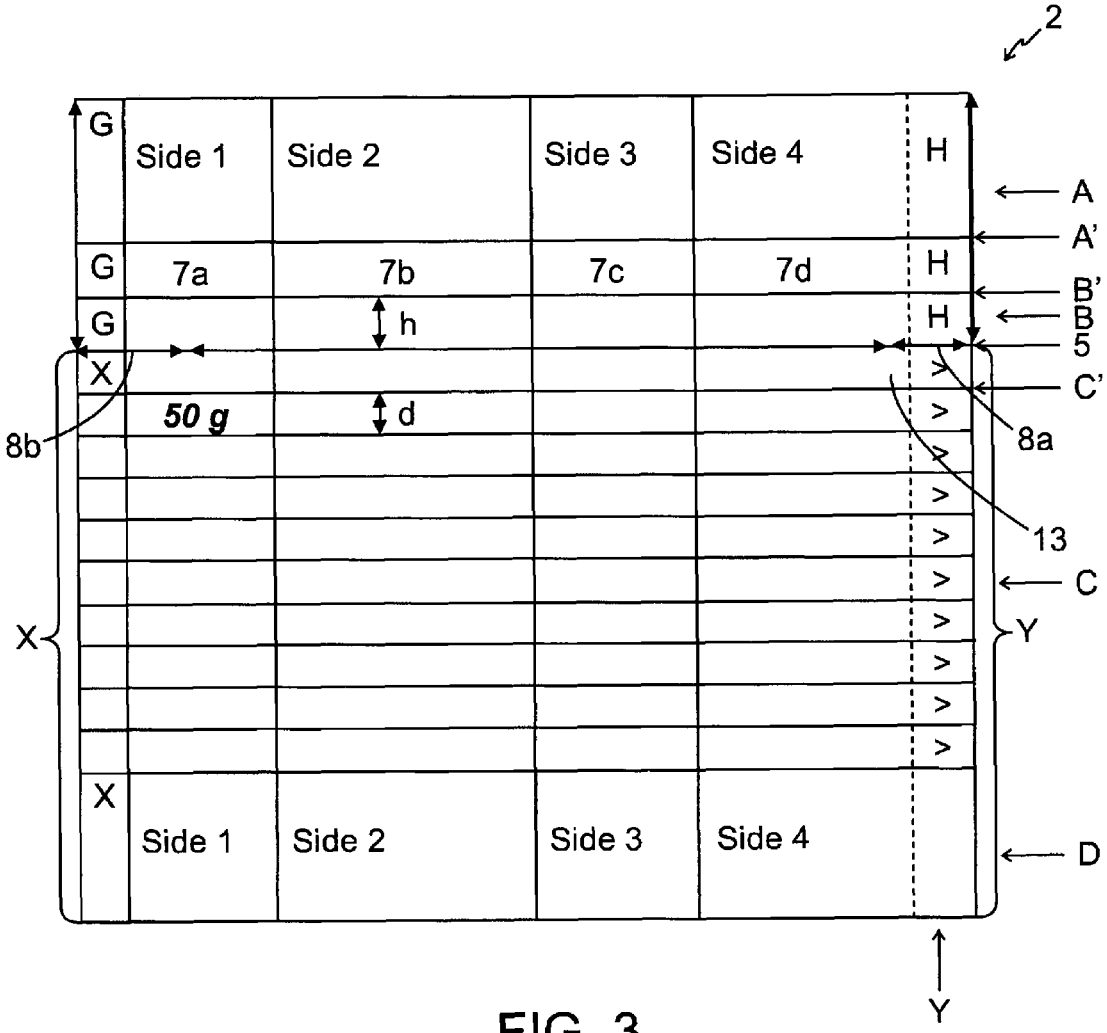
FIG. 3 is a view of a sheet from above for manufacturing a package according to an embodiment of the present invention.

Reference is now also made to FIG. 3 illustrating a view of a sheet from above for manufacturing the package in a single piece of flexible sheet illustrated in FIG. 1.

FIG. 3 illustrates a sheet 2 for manufacturing a package manufactured in a single piece of a flexible sheet material, which package comprises a lid that can be opened and re-closed, which is integrated with the package. The sheet 2, in this particular embodiment, is essentially rectangular and divided into a set of transverse fields A, B, C, and D, divided by means of perforations and/or punched lines. The fields are not physically divided to each other but altogether form single piece of sheet 2.

The sheet 2 comprises a first field A for forming a top surface of the lid 3, a second field B located adjacent and in parallel to the first field A, for forming the side walls 7*a-d* of the lid 3 by means of double-folded sheet material. The height h of this second field B is typically higher than the height d of the tear-off strips 13.

A third field C is located arranged adjacent and in parallel to the second field B for forming the side walls 19 of the package 1, and a fourth field D is arranged adjacent and in parallel to the third field C for forming a bottom surface of the package 1. The second and the third fields B, C are divided by a perforation line 5 and a first cut 8*a* and a second cut 8*b* are provided in a respective end region 8*a, b* of the perforation line 5. Typically, the length of the cuts 8*a, b* is adapted in accordance with the stiffness of the sheet material such that stiffer sheet material requires longer cuts 8*a, b* for supporting the opening of the lid the first time. In case the cuts 8*a, b* are too short, the lid 3 will risk being folded during opening.

The sheet 2 is divided further in a longitudinal direction, in five fields located adjacent to each other in a similar way as disclosed above: a first longitudinal field X, a first, second, third and fourth longitudinal side fields side 1, side 2, side 3, side 4 and a second longitudinal field Y, of which the first, second, third and fourth longitudinal side fields side 1, side 2, side 3, side 4 make up the side walls 19 of the package 1.

The sheet material of the sheet 2 is punched, such that punched lines are pressed into the sheet material such that the tear-off strips 13 will come loose during tearing-off along the punch lines C'. The punched lines c' are punched with a distance d to each other of say 5-20 mm, or correspond to a particular weight such as 50 g depending on the size of the packet.

Figure 4:
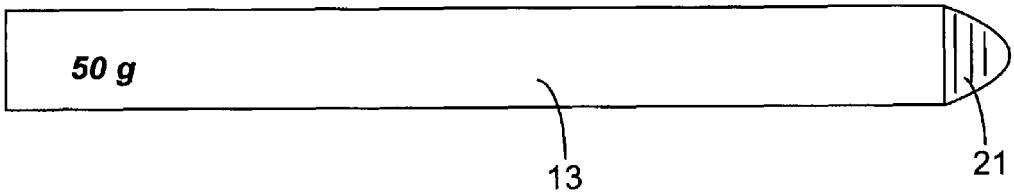
FIG. 4 is a view of a tear-off strip having a grip-flap shown in enlargement.

Now is referred to FIG. 4 illustrating a tear-off strip 13 having a grip-flap 21 in enlargement. At an end of each tear-off strip 13, a grip-flap 21 can be provided for enabling a user to grip and tear-off the tear-off strip 13. The grip-flaps are typically cut out.

The sheet 2 can be made of paper, waxed paper, foil or plastics, paper board, cardboard, or metal or suitable material or any combination thereof. The sheet may comprise only one material layer of the same kind, or multiple layers including any combination of the same or different materials.

The package 1 can be manufactured at high speed from a flexible sheet material, since there are no parts extending from the sheet material, or other loose parts such as flaps since all the parts, i.e. walls, lid etc of the package are totally integrated with the package.

Typically, the package 1 is made of sheet material supported at high speed from a roll in a conventional packaging machine. The flexible sheet can be pre-cut and pre-punched or cut and punched in the packaging machine, or alternatively in advance.

In the following, manufacturing of the package 1 by means of folding the sheet 2 will be described in more detail. Reference is made to FIGS. 1, 2 and 3.

To start, the lid 3 is manufactured.

The lid 3 has a top surface made of sheet material of the first field A. The top surface, which is also top surface of the lid 3, can be made by means of:

a) folding sides inwards along line A'. First side 1, then side 3, then side 4 and finally side 2, which is glued.

b) conventional envelope folding such as gift-wrap or by means of end-side folding, i.e. one side, a wider side if the package 1 is rectangular, is folded to the centre of the edge, then smaller sides to the centre, and finally an opposite wide side is folded to the centre.

The side walls 7*a-d* is made of double-folded sheet material folded by means of double-folding the second field B downwards to the perforation line 5 and back upwards. Line B' is folded against line C' such that a first tear-off strip 13 "tear-off strip 1" is hidden. The corner of the lid 3 is folded before the longitudinal side is glued. The longitudinal side can be glued, or not depending on requirements. The longitudinal side X-Y and the gluing of the edge G-H are glued separately from each other. The longitudinal flap side X is glued against the inside of side Y. The longitudinal flap side X is used for joining the package along its longitudinal side. The flap side X is glued along Y under the tear-off strips, marked with symbol ">" such that the grip-flaps 21 of the tear-off strips 13 are not glued.

According to an alternative embodiment, it is also possible to glue the double-folded side walls 7*a-d*.

There are cuts 8*a, b* in the perforation line 5 in distal opposite ends thereof such that loose lid flaps 11*a*, 11*b* are provided on each side of the sheet 2. When the package 1 is folded along a longitudinal side 7*b*, a loose corner 12 is provided in the lid 3. The sides 7*a-d* of the lid 3 are joined to each other in the corner 12 where the lid 3 is to be lifted for breaking the perforation 5. It is only the edges of the lid 3 that are joined to each other, not the sides 19 of the package 1.

In this way, a loose corner is provided in the lid 3 when the package 1 has been folded and glued along a longitudinal side for attaching the edge of the lid 3. This implies that the lid 3 can be bent up there whereby the perforation line 5 will break during opening of the package 1 for the first time. An arrow 15 or any other symbol or wording, such as "OPEN HERE" or the like can be printed on the lid 3 to guide the user to open the lid properly. The lid 3 can be put back to reclose the package 1, also after partial drawing of the product.

Typically, the first cut 8*a* is about 30 mm in length and the second cut 8*b* is about 30 mm+ the width of field X in length. This implies typically for a standard package having 500 g content such as a butter package. Thus, other lengths are possible and even preferred for other packages having other content such as 1000, or 5 000 g.

According to an alternative embodiment, the lid 3 may have a thumb-grip (not shown), which can be a cut. In this way, it is easier for a user to remove the lid 3 even when the lid 3 covers the lowest (last) tear-off strip.

The bottom of the package can be made by folding side 1, side 3, side 4 and finally side 2, which is glued.

Typically, the heights of the edges of the lid 3 are higher than the heights of the tear-off strips to cover the part of the content that is exposed following when a tear-off strip has been teared-off.

The sheet material is typically stiff, at least somewhat, to provide a certain resistance against folding. If the sheet material is too soft, it will probably wrinkle when the user tries to break the lid. It is also possible that the lid will fit too tight such that it cannot be removed easily. Thus, the sheet material is typically stiff enough to provide a clearance between the edges of the lid and the sides of the package.

The content can be poured into the package in melted form or alternatively, the package can be folded and glued around the pre-cut product such as a block of grease.

Embodiments of the invention have been described above with reference to FIGS. 1-4. However, those skilled in the art will readily appreciate that the detailed description given herein with respect to these figures is for explanatory purposes as the invention extends beyond these limited embodiments.

The foregoing detailed description is intended to illustrate and provide easier understanding of the invention, and should not be construed as limitations. Alternative embodiments will become apparent to those skilled in the art without departing from the spirit and scope of the present invention.

The invention claimed is:

1. A package manufactured from a single piece of a flexible sheet, the package comprising:

a lid that is integrated with the package, such that the lid can be opened and reclosed;

wherein the lid is joined to the package along a perforation line;

wherein the lid has side walls of double-folded sheet being folded downwards to the perforation line and back upwards; and wherein cuts are provided in the perforation line in distal ends thereof, such that loose lid flaps are provided on each side of the sheet and a loose corner is provided in the lid when the package is folded along longitudinal sides.

2. The package according to claim 1, wherein the sheet is made of paper, waxed paper, foil, plastics, paper board, cardboard, or any combination thereof.

3. The package according to claim 1, further comprising transverse tear-off strips arranged around the package.

4. The package according to claim 3, wherein each tear-off strip is provided with a weight or volume indication of content in the package for a particular weight or volume based partial drawing of the content.

5. The package according to claim 1, joined by means of gluing along a longitudinal side of the package.

6. A sheet for manufacturing a package manufactured from a single piece of a flexible sheet material, the package comprising a lid that is integrated with the package, such that the lid can be opened and reclosed, the sheet being rectangular and divided into a set of transverse fields by perforation lines or punched lines, the sheet comprising:

a first field for forming a top surface of the lid;

a second field located adjacent and parallel to the first field, and arranged to form side walls of the lid;

a third field arranged to form side walls of the package; and a fourth field arranged to form a bottom surface of the package;

wherein the second and the third fields are divided by a perforation line; and wherein first and second cuts are provided in respective distal end regions of the perforation line, such that loose lid flaps are provided on each side of the sheet for providing a loose corner in the lid when the package is folded.

7. The sheet according to claim 6, wherein the first cut and the second cut are of different length; and wherein, for a package having 500 g content, the first cut is about 30 mm and the second cut is about 30 mm+ the width of a longitudinal side.

8. A method for manufacturing a sheet for manufacturing a package by folding, the method comprising:

providing a sheet for manufacturing a package;

punching and perforating the sheet to form folding and tearing lines to provide a first field for forming a top surface of a lid, a second field located adjacent and parallel to the first field, and arranged to form side walls of the lid, a third field arranged to form side walls of the package, and a fourth field arranged to form a bottom surface of the package, wherein the second and the third fields are divided by a perforation line; and providing first and second cuts in respective distal end regions of the perforation line, such that loose lid flaps are provided on each side of the sheet for providing a loose corner in the lid when the package is folded.

* * * * *